US006883897B2

(12) United States Patent
Kinoshita et al.

(10) Patent No.: US 6,883,897 B2
(45) Date of Patent: Apr. 26, 2005

(54) INK JET RECORDING APPARATUS AND CLEANING UNIT THEREOF

(75) Inventors: Hiroyuki Kinoshita, Kanagawa (JP); Hiroyuki Tanaka, Kanagawa (JP); Atsushi Sakamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/452,501

(22) Filed: Jun. 3, 2003

(65) Prior Publication Data

US 2003/0227507 A1 Dec. 11, 2003

(30) Foreign Application Priority Data

Jun. 7, 2002 (JP) ..... 2002/166920

(51) Int. Cl.[7] ..... B41J 2/165
(52) U.S. Cl. ..... 347/33
(58) Field of Search ..... 347/22, 32, 33, 347/29

(56) References Cited

U.S. PATENT DOCUMENTS 5,500,660 A * 3/1996 Childers et al. ..... 347/33
6,109,725 A 8/2000 Saikawa et al. ..... 347/33
6,189,998 B1 2/2001 Yanagi ..... 347/33
6,213,582 B1 * 4/2001 Uchida et al. ..... 347/33
6,460,968 B1 * 10/2002 Chee et al. ..... 347/33
2003/0007030 A1 1/2003 Sakamoto et al. ..... 347/31

OTHER PUBLICATIONS

U.S. Appl. No. 10/446,720, filed May 29, 2003 (Tanaka), issued pat. # pending.
U.S. Appl. No.10/456,623, filed Jun. 9, 2003 (Sakamoto), FN mailed Dec. 21, 2004.

* cited by examiner

*Primary Examiner*—Shih-wen Hsieh
(74) *Attorney, Agent, or Firm*—Fitzpatrick, Cella, Harper & Scinto

(57) ABSTRACT

In an inkjet recording apparatus which is equipped with a recording head having a discharge opening surface on which plural different-length discharge opening arrays are disposed in parallel, plural wipers are provided for wiping off the discharge opening surface in a direction intersecting the discharge opening arrays. Each of the plural wipers has a main wiping section corresponding to the length of the corresponding discharge opening array, notch sections capable of avoiding convex portions or concave portions located in the vicinity of both the ends of the corresponding discharge opening array, and a sub wiping section corresponding to an area other than the discharge opening array and the convex or concave portions, whereby it is possible to effectively wipe off the discharge opening surface by a simple structure and easily output a high-quality recording result by an inexpensive mechanism.

7 Claims, 5 Drawing Sheets

INK JET RECORDING APPARATUS AND CLEANING UNIT THEREOF

BACKGROUND OF THE INVENTION

1. Field of the Invention

The present invention relates to an inkjet recording apparatus which performs recording by discharging inks from a recording head having plural discharge opening arrays to a recording material (i.e., a material to which recording is performed), and a new structure of a cleaning unit of the inkjet recording apparatus.

2. Related Background Art

A recording apparatus which has functions as a printer, a copying machine, a facsimile machine and the like or a recording apparatus which is used as an output instrument for a multifunctional electronic apparatus including a computer, a word processor or the like, a work station and the like is configured to record images (including characters, symbols, etc.) on a recording material (or a recording medium) such as paper, cloth, a plastic sheet, an OHP sheet or the like on the basis of recording information. Incidentally, in a serial-type recording apparatus which performs recording while effecting a main scan in the direction perpendicular to a conveying direction of the recording medium, an image is recorded by a recording head (recording means) which is mounted on a carriage moving along the recording medium, sheet feeding is performed by a predetermined pitch after the recording of one line has ended, and thereafter an image of a next line is recorded on the recording material again stopped. Thus, by repeating such operations, the recording on the recording medium is performed as a whole. On one hand, in a line-type recording apparatus which performs recording only in a conveying direction of the recording material, the recording material is first set at a predetermined position, recording of one line is performed, subsequently the recording material is fed by a predetermined pitch, and thereafter recording of a next line is performed. Thus, by repeating such operations, the recording on the recording material is performed as a whole.

Moreover, among the above recording apparatuses, as to an inkjet recording apparatus which performs recording by discharging inks from a recording head to the recording material, the recording means thereof can be easily made compact in size, a high-precision image can be recorded at high speed, and also the recording can be performed on plain paper without any specific process. Moreover, there are advantages that, for example, the running cost is low, noise is of a low level because a non-impact system is adopted, and a color image can be easily recorded by using various kinds of inks (e.g., color inks). In addition, while there are various demands for the material of the recording medium to be used in the inkjet recording apparatus, developments to cope with these demands are advanced in recent years, whereby cloth, leather, nonwoven cloth, and even metal are used in addition to the ordinary recording paper, a resin thin plate (OHP sheet etc.) and the like.

In the inkjet recording apparatus, since the recording is performed by discharging the ink from a minute discharge opening, the ink becomes sticky and is firmly adhered due to evaporation of the ink (i.e., evaporation of solvent) in the vicinity of the discharge opening, the ink and such dust as paper dust or the like are adhered to the surface of the discharge opening, and bubbles are generated and mixed in the ink within the discharge opening. Thus, due to these disadvantages, defective discharge such as unevenness of the discharged ink, non-discharge of ink or the like might occur. To prevent the defective discharge, a cleaning unit (recovery mechanism unit) to maintain and recover the ink discharge performance of the recording head to an excellent state is provided. As a cleaning processing means to be provided in the cleaning unit, a suction recovery means to eliminate plugging by sucking the ink from the discharge opening, a wiping means to wipe off the surface of the discharge opening by rubbing the surface of the discharge opening with a wiper, and the like are generally used.

The suction recovery means covers the discharge opening of the recording head by a cap connected to a suction pump, and also generates a negative pressure in the cap by activating the suction pump. Then, sticky ink, and foreign substance such as bubbles and the like are discharged together with the ink from the discharge opening by means of the negative pressure, and new ink is instead introduced into the discharge opening, thereby maintaining and recovering the ink discharge performance of the recording head. Moreover, the wiping means wipes off and thus eliminates the ink, and foreign substances such as dust and the like which have been adhered to the surface of the discharge opening of the recording head by relatively moving and rubbing the discharge opening of the recording head and the wiper of the cleaning unit with each other.

The wiper is mounted in the wiping means so that it can be moved (i.e., projected and evacuated) on the moving path of the surface of the discharge opening of the recording head. Then, the recording head and the wiper are relatively moved in the state that the wiper is being projected, and wasted ink, dust and the like adhered to the surface of the discharge opening are thus scraped out by the end of the wiper to clean up the surface of the discharge opening, thereby solving the defective discharge, and thus maintaining and recovering the ink discharge performance of the ink discharge opening. Moreover, in the wiping means of the inkjet recording apparatus, such as a color-recording inkjet recording apparatus, a gradation-recording inkjet recording apparatus or the like, which uses the recording head having the plural discharge opening arrays to respectively discharge different kinds of inks, the plural wipers respectively corresponding to the plural discharge opening arrays are used to wipe off the corresponding arrays respectively.

However, conventionally, in the inkjet recording apparatus which includes the cleaning unit (wiping means) to wipe off the plural discharge opening arrays that respectively discharge the different inks by using the plural wipers respectively corresponding to these arrays, it is impossible to effectively prevent the various kinds of inks remaining on the surface of the discharge openings after the wiping process has ended from penetrating into other different ink discharge opening arrays, whereby the following technical problem to be solved occurs. That is, color mixture in which the different inks are mixed together easily occurs, whereby quality deterioration on the recorded image easily occurs due to the color mixture. Moreover, in a case where a convex portion (i.e., a protuberated or protruding portion) and a concave portion which cannot be avoided due to a manufacturing method and an internal structure of the recording head are formed at the end of each discharge opening array, the following technical problem occurs. That is, the wiper runs on the convex portion or is caught by the concave portion, and thus the surface of the discharge opening (particularly the portion corresponding to the discharge opening array) cannot be sufficiently wiped off.

SUMMARY OF THE INVENTION

An object of the present invention is to provide an inkjet recording apparatus which can effectively wipe off, even in a case where a discharge opening surface of a recording head on which plural different-length discharge opening arrays are disposed is wiped off by using plural wipers, the discharge opening surface by a simple structure and thus can easily output a high-quality recorded result by an inexpensive mechanism, and a cleaning unit of the inkjet recording apparatus.

Another object of the present invention is to provide an inkjet recording apparatus which performs recording by discharging inks to a recording material from a recording head having a discharge opening surface on which plural different-length discharge opening arrays are disposed in parallel, and further comprises plural wipers for wiping off the discharge opening surface in a direction intersecting the discharge opening arrays, wherein each of the plural wipers has a main wiping section corresponding to the length of the corresponding discharge opening array, notch sections capable of avoiding convex portions or concave portions located in the vicinity of both the ends of the corresponding discharge opening array, and a sub wiping section corresponding to an area other than the discharge opening array and the convex or the concave portions.

DETAILED DESCRIPTION OF THE PREFERRED EMBODIMENTS

First Embodiment

Figure 1:
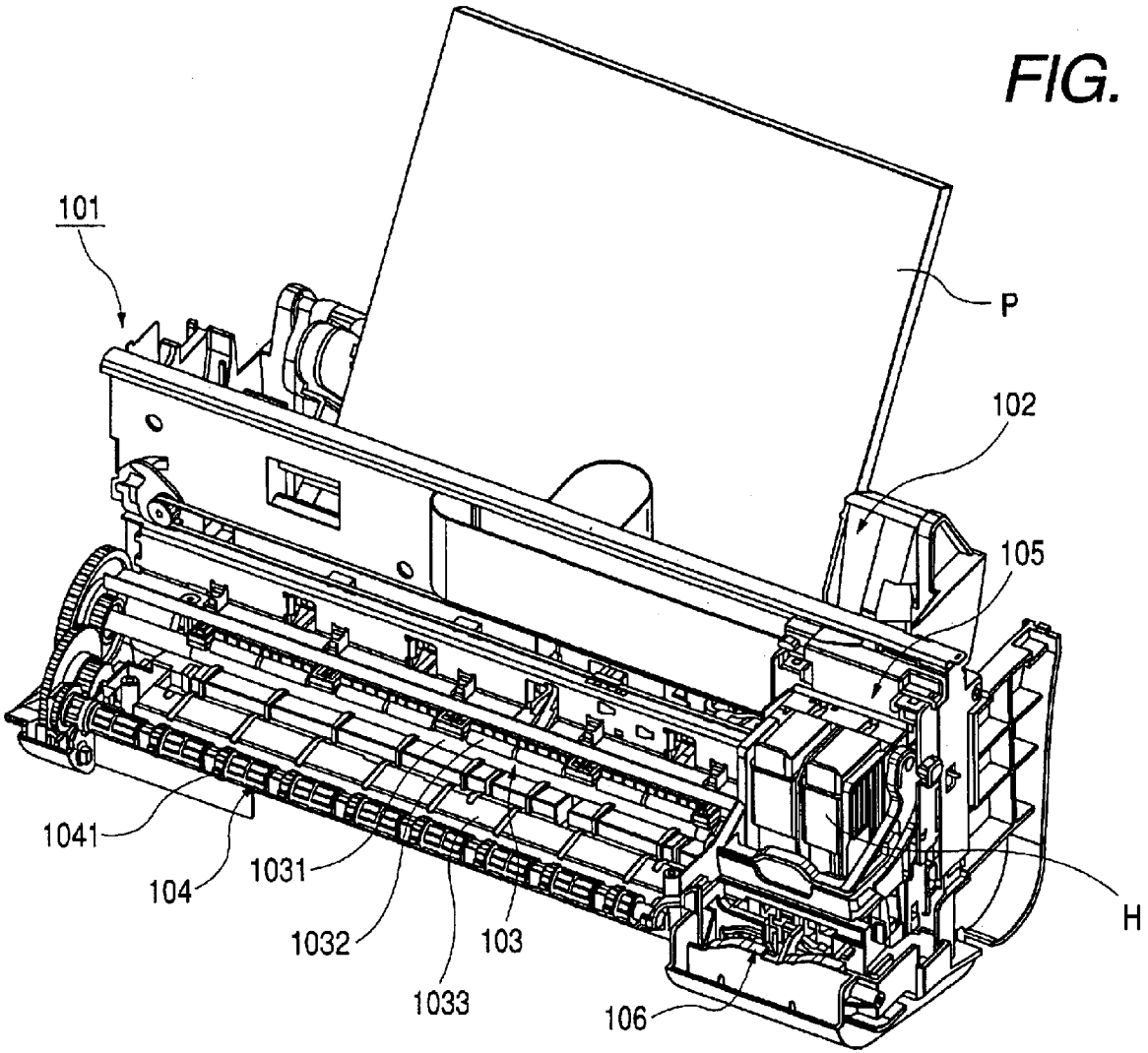
FIG. 1 is a schematic perspective view showing the first embodiment of an inkjet recording apparatus, to which the present invention is applied.

Hereinafter, the embodiments of the present invention will be concretely explained with reference to the attached drawings. Incidentally, it is assumed that that the same numerals (or symbols) shown in the drawings indicate the same or corresponding portions, respectively.

FIG. 1 is a schematic perspective view showing the first embodiment of an inkjet recording apparatus to which the present invention is applied. In FIG. 1, an inkjet recording apparatus 101 is composed of a sheet feed unit 102, a sheet conveying unit 103, a sheet discharge unit 104, a carriage unit (main scanning mechanism unit) 105, a cleaning mechanism unit (recovery mechanism unit) 106 and the like. This inkjet recording apparatus is a recording apparatus such as a printer, a facsimile machine or a copying machine which executes a recording process by discharging the ink from a recording head H mounted on the carriage unit 105 to a sheet-shaped recording material (or a recording medium) P such as a recording sheet or the like. In the cleaning mechanism unit 106, a wiping means having wipers used for wiping off and eliminating foreign substances such as ink, dust and the like adhered to an ink discharge opening surface of the recording head H is provided.

The sheet feed unit 102 stacks blank recording material P of plural sheets, which are separately fed one by one to the sheet conveying unit 103 by a sheet feed roller (not shown). The sheet conveying unit 103 is composed of a sheet conveying roller (or a transportation roller) 1031, a pinch roller 1032, a platen 1033 and the like. The recording material P transferred from the sheet feed unit 102 is transferred to the sheet discharge unit 104 passing through a surface of the platen 1033 while being pinched and supported by the cooperation between the sheet conveying roller 1031 which is rotatively driven by a driving system (not shown) and the pinch roller 1032 which is dependently rotated contacting with the sheet conveying roller 1031. The platen 1033, which maintains the recording material P in a flat state while guide-supporting it, has a function of oppositely causing the recording material P in face the ink discharge opening surface of the recording head H mounted on the carriage unit 105 with a predetermined gap (sheet-to-sheet interval).

The sheet discharge unit 104 discharges the recording material (ordinarily, the recorded recording material) P transferred from the sheet conveying unit 103 externally of the main body of the recording apparatus 101. At this time of discharging the recording material P, since the ink has just adhered to a recording surface (the face) of the recording material P, the recording material P is in a state of getting wet with the ink which is not yet dried. Therefore, since the sheet discharge unit 104 ordinarily conveys the wet recording material P while pinching and supporting it, a sheet discharge roller 1041 formed by a member of a large frictional coefficient such as rubber or the like is contacted with a back side (a surface opposite to a recording surface) and a spur (not shown) is contacted with the recording surface of the recording material P. The discharge roller 1041 is rotatively driven in synchronism with (interlocked with) the rotation of the sheet conveying roller 1031. The spur is structured by a thin metallic circle plate of which the circumference has plural projections having sharp-pointed ends. By that shape, even if the recording material P, which contacts with a surface of the other recording material P which is wet with the ink, is rotated while press-contacting with the sheet discharge roller, the recording material P can be conveyed without transferring the ink to other spots.

The carriage unit 105 acting as the main scanning mechanism unit mounts the recording head H and performs a scanning (main scanning) at the time of recording by reciprocating on the recording material P supported by the platen 1033. At this time, in the carriage unit 105, the recording head H is mounted (on the carriage) in a state where the position is determined so that the gap (sheet-to-sheet interval) between the ink discharge opening surface (the surface where the ink discharge opening is formed) of the recording head H and the recording surface of the recording material P becomes an appropriate condition. The recording head H discharges the ink from an ink discharge opening provided on the ink discharge opening surface and thus forms images (which include characters, symbols and the like) by adhering the discharged ink droplets to the surface of the recording material P. In the above structure, the image is formed on a predetermined area of the recording material P by discharging the ink from the recording head H with the appropriate timing on the basis of recording information while repeating the main scanning by the carriage unit 105 and the conveying (sub scanning) of the recording material P by the sheet conveying unit 103.

The recording head H acting as a recording means is an inkjet recording means for discharging the ink using the thermal energy, and an electrothermal converter used for generating the thermal energy is provided in this head. The recording head H causes the thermal energy, which is to be applied by the electrothermal converter, to produce the film boiling in the ink, and the ink is discharged from the ink discharge opening by using the pressure change due to the growth and contraction of bubbles produced in the course of producing the film boiling and then the recording (print) is performed.

Figure 5:
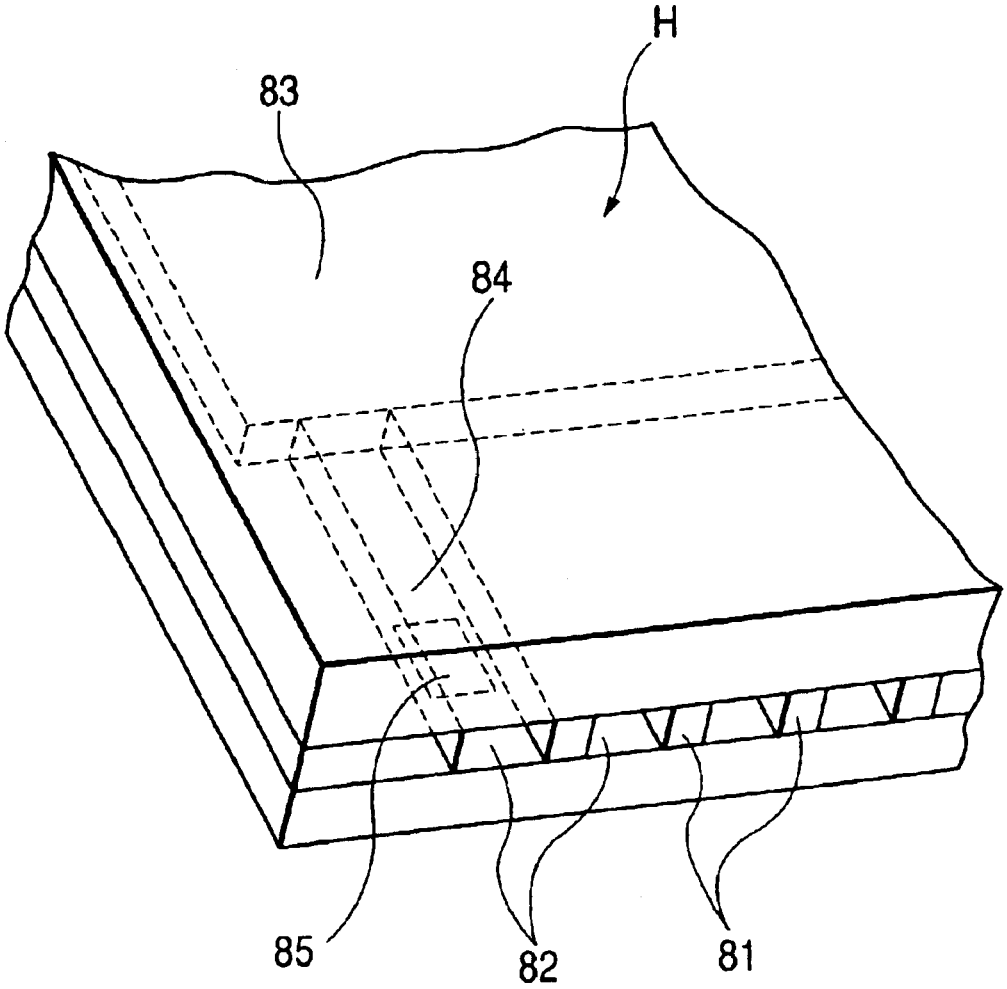
FIG. 5 is a partial perspective view schematically showing the structure of an ink discharging portion of the recording head shown in FIG. 1.

FIG. 5 is a partial perspective view schematically showing the structure of an ink discharge portion of the recording head H. In FIG. 5, an ink discharge opening array structured by plural ink discharge openings 82 with a predetermined pitch is formed on an ink discharge opening surface 81 opposite to the recording material (recording medium) P such as a recording sheet or the like with a predetermined gap (e.g., about 0.2 mm to 2.0 mm), and an electrothermal converter (thermal generation resistor or the like) 85 used for generating energy for discharging the ink is disposed along the wall surface of each liquid path 84 which connects each of the ink discharge openings 82 with a shared liquid chamber 83. The recording head H is mounted on the carriage in such a positional relationship where the plural ink discharge openings 82 are disposed in the direction intersecting the main scanning direction (moving direction of the recording head H). Thus, the corresponding electrothermal converter 85 is driven (i.e., supplied with electricity) on the basis of an image signal or a discharging signal to produce the film boiling for the ink in the liquid path 84, and the recording head (recording means) H which discharges the ink from the ink discharge openings 82 by using the pressure generated at the time of producing the film boiling is structured.

In FIG. 1, the cleaning mechanism unit 106 maintains the ink discharge performance of the recording head H to a fine state or recovers that performance to a fine state by eliminating dust or viscosity-increased ink (or adhered ink) from the ink discharge openings 82 of the recording head H or the periphery thereof and further discharging the bubbles generated in the ink discharge openings 82. The cleaning mechanism unit 106 ordinarily includes a cap for covering the ink discharge opening surface 81, a suction pump, which acts as a negative pressure generation source, for suctioning the ink from the ink discharge openings 82, a wiping means for wiping and cleaning the ink discharge opening surface 81 by the wiper, and the like.

In the cleaning mechanism unit (recovery mechanism unit) 106 according to the present embodiment, there is provided the wiping means for wiping off and eliminating foreign substances such as ink, dust and the like adhered to the ink discharge opening surface 81 by relatively moving and thus effecting rubbing of the ink discharge opening surface 81 of the recording head H and the wiper used for wiping off the ink discharge opening surface. In the wiping means, the wiper is mounted so that it can be moved (i.e., projected and evacuated) on the moving path of the main scanning of the ink discharge opening surface 81 of the recording head H. Then, the recording head H and the wiper are relatively moved in the state that the wiper is being projected, and wasted ink, dust and the like adhered to the ink discharge opening surface 81 are scraped out by the end of the wiper to clean up the ink discharge opening surface 81, thereby performing a cleaning operation of maintaining the fine ink discharge performance after solving the defective discharge due to the adhered substances on the ink discharge opening surface.

Figure 2B:
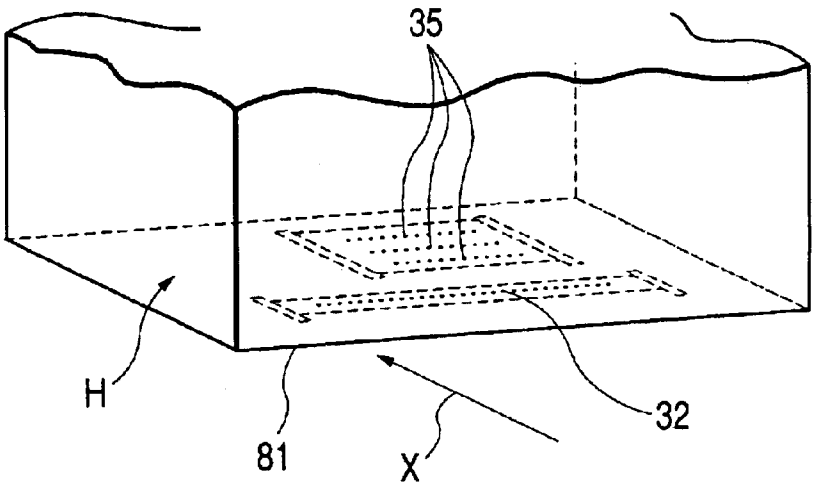
FIG. 2B is a schematic perspective view showing a recording head in the first embodiment of the inkjet recording apparatus.
Figure 2A:
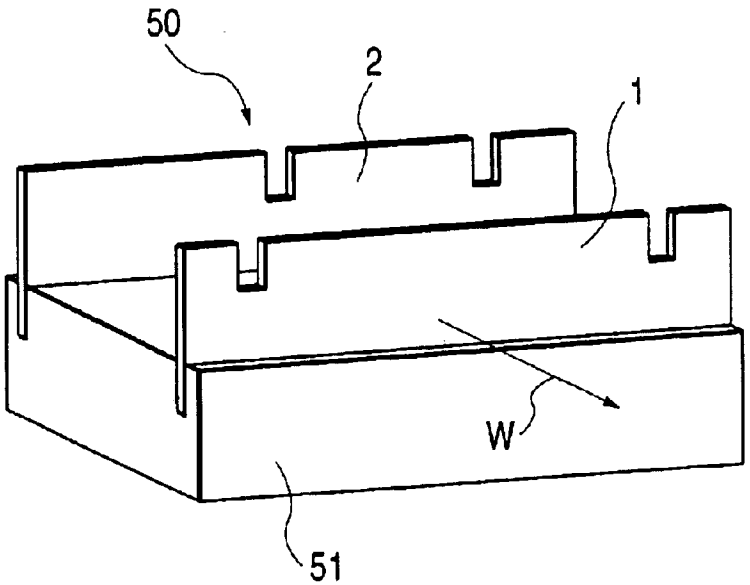
FIG. 2A is a schematic perspective view showing a wiping means in the first embodiment of the inkjet recording apparatus.
Figure 3:
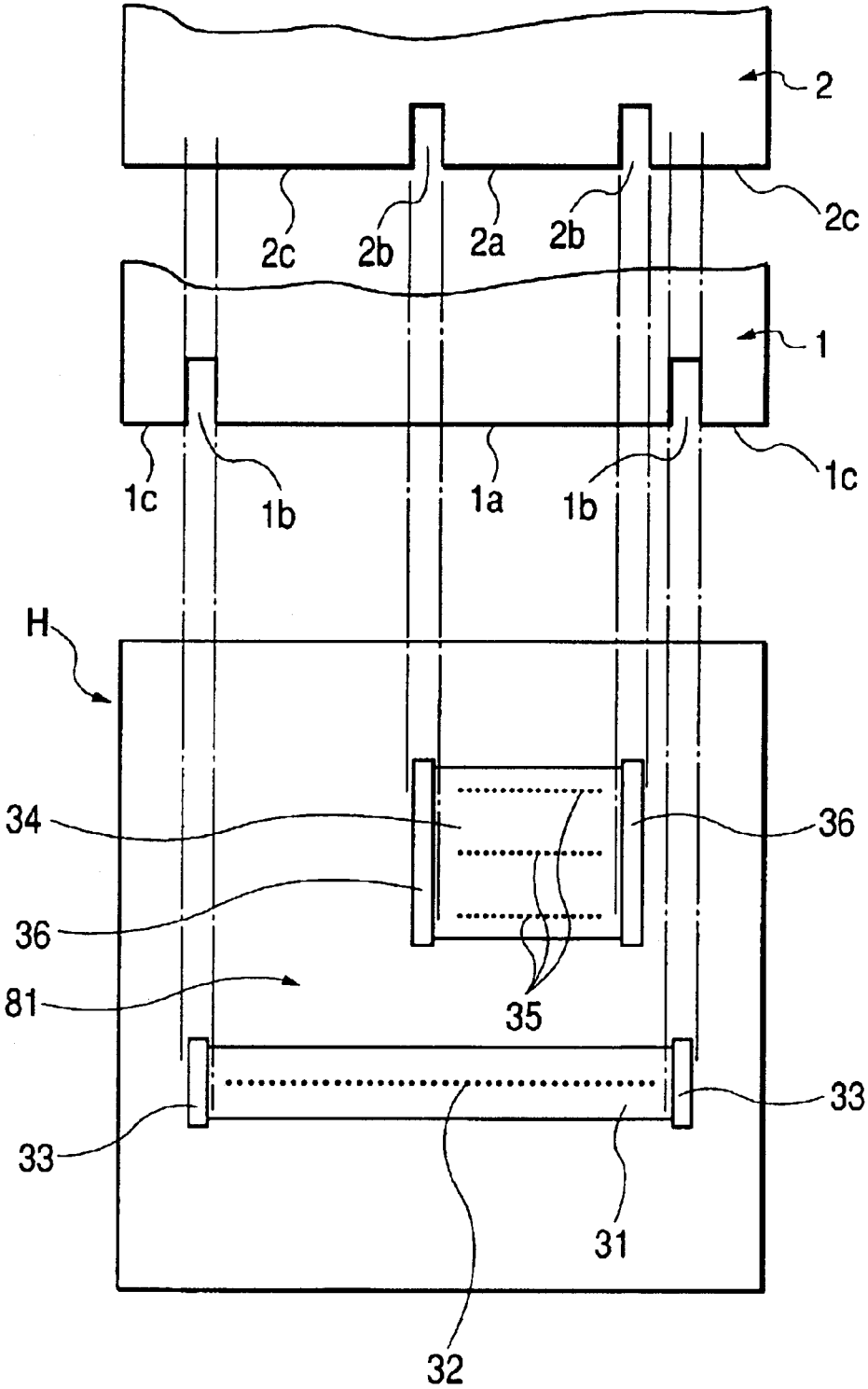
FIG. 3 is an explanation view schematically showing the disposition structure on a relative moving path between plural ink discharge opening arrays on an ink discharge opening surface of the recording head and end portion shapes of plural wipers of the wiping means, both shown in FIGS. 2A and 2B.

FIGS. 2A and 2B are schematic perspective views respectively showing a wiping means 50 and the recording head H in the first embodiment of the inkjet recording apparatus, to which the present invention is applied. FIG. 3 is an explanation view schematically showing the disposition structure on a relative moving path between plural ink discharge opening arrays on the ink discharge opening surface 81 of the recording head H and end portion shapes of plural wipers of the wiping means 50 shown in FIGS. 2A and 2B. In FIGS. 2A and 2B and FIG. 3, plural ink discharge opening arrays 32 and 35 respectively having the different lengths are disposed (formed) in parallel on the ink discharge opening surface 81 of the recording head (recording means) H. In the wiping means 50, there are provided plural (i.e., two in the drawing) wipers 1 and 2 for wiping off the ink discharge opening surface from the direction intersecting the ink discharge opening arrays (i.e., perpendicular to the ink discharge opening arrays in the drawing).

The ink discharge opening surface 81 of the recording head H is almost a single surface, in which there are provided plural rectangle chip surfaces on which the ink discharge opening arrays 32 and 35 are respectively formed and a substrate surface having an electric circuit for supplying electricity and signals used for discharging the ink from the ink discharge opening arrays 32 and 35. Each periphery of the rectangle chip surfaces is surrounded by the substrate surface. Moreover, each of the chip surfaces is electrically connected to the substrate surface by a wire bonding, and a joint between the chip surface including the wire bonding portion and the substrate surface is sealed by the sealing material. The wire bonding portions are provided on two sides which are located in the vicinity of both edges of the ink discharge opening arrays on each of the chip surfaces.

The shape of the wire bonding portion is in a state of slightly protuberating. Therefore, in the embodiment shown in FIG. 3, convex portions (protuberated portions) 33 and 33 are formed on the two sides which are located in the vicinity of both the edges of the ink discharge opening array of a first chip surface 31 having the first ink discharge opening array (black ink discharge opening array) 32, and convex portions (protuberated portions) 36 and 36 are formed on the two sides which are located in the vicinity of both the edges of the ink discharge opening array of a second chip surface 34 having the second ink discharge opening array (color ink discharge opening array) 35. In the present embodiment, the recording head H has the two chip surfaces 31 and 34 within the ink discharge opening surface 81, and the first chip surface 31 has the first ink discharge opening array 32 for discharging the black ink, while the second chip surface 34 has the second ink discharge opening array (color ink discharge opening array) 35 structured by three arrays for discharging the ink of each color of cyan, magenta and yellow. Therefore, the first ink discharge opening array 32 is structured by the one ink discharge opening array, however, the second ink discharge opening array 35 is structured by plural (three) ink discharge opening arrays.

In the present embodiment, the length of the second ink discharge opening array 35 is shorter than the length of the first ink discharge opening array 32. Moreover, the first ink discharge opening array 32 and the second ink discharge opening array 35 are disposed in parallel, and the one edge (the right edge in FIG. 3) of the first ink discharge opening array 32 is disposed slightly outside the second ink discharge opening array 35 while the other edge (the left edge in FIG. 3) of the first ink discharge opening array 32 is disposed exceedingly outside the second ink discharge opening array 35.

The recording head H mounted on the carriage unit 105 can reciprocate in the direction intersecting the disposed direction of the ink discharge opening arrays 32 and 35, and the ink discharge opening surface 81 of the recording head H is wiped off by the wipers 1 and 2 in the direction intersecting the disposed direction of the ink discharge opening arrays 32 and 35. Hereinafter, the wiper 1 is called a first wiper, and the wiper 2 is called a second wiper. The first wiper 1 is provided corresponding to the first ink discharge opening array 32 provided on the first chip surface 31, and the second wiper 2 is provided corresponding to the second ink discharge opening array 35 provided on the second chip surface 34.

The first and second wipers 1 and 2 are mounted on a wiper holder 51 so that wasted ink, dust and the like adhered to the ink discharge opening surface 81 are scraped out by the ends of the wipers 1 and 2 by effecting relative movement of the wiper holder 51 and the recording head H. The relative movement in this case can be realized in the case that the wiper holder 51 is moved in the direction of the indicated arrow W by a driving means (not shown) or the recording head H is moved in the direction of the indicated arrow X or both the wiper holder 51 and the recording head H are moved. The wiping operation according to the present invention may adopt any of the above movement methods.

In FIGS. 2A and 2B and FIG. 3, the wipers 1 and 2 are mounted on a moving path of the ink discharge opening surface 81 of the recording head H reciprocating so that they can be vertically moved in such a manner that the ends of the wipers project and retract by moving the wiper holder 51 in the vertical direction by an appropriate driving means. When the end of the wiper projects, it contacts with the ink discharge opening surface 81 in accordance with the relative movement with the recording head H and wipes off ink droplets, foreign substances and the like adhered to the ink discharge opening surface. In this case, as described above, the convex portions 33 and 36 are formed because the sealing material which covers the wire bonding protuberates on the portions located in the vicinity of both the edges of the ink discharge opening array. If the end of the wiper runs on the convex portions, it is feared that the ink discharge opening located in the vicinity of the edge of the ink discharge opening array cannot be sufficiently wiped off.

Therefore, to solve the inconvenience owing to the defective wiping, notch portions (concave portions) for avoiding the convex portions 33 and 36 are formed at the end of each of the wipers. That is, at the end portion of the first wiper 1, notch portions 1*b* and 1*b* for avoiding the convex portions 33 and 33 at both the edges of the first chip surface 31 are formed, and at the end portion of the second wiper 2, notch portions 2*b* and 2*b* for avoiding the convex portions 36 and 36 at both the edges of the second chip surface 34 are formed. In the following explanation, the portion, which is located between the end portions of the wipers 1 and 2 and which is further in contact with the ink discharge opening surface 81, is called a wiping section.

That is, at the first wiper 1, a main wiping section 1*a* for wiping off an area of the first ink discharge opening array 32 and sub wiping sections 1*c* and 1*c* for wiping off outside areas of the first ink discharge opening array 32 are formed. At the second wiper 2, a main wiping section 2*a* for wiping off an area of the second ink discharge opening array 35 and sub wiping sections 2*c* and 2*c* for wiping off outside areas of the second ink discharge opening array 35 are formed. These wipers 1 and 2 are disposed in parallel with the ink discharge opening arrays 32 and 35, and mounted so that they can be vertically moved interlocking with each other. When the end portions of the wipers project within an area of the moving path of the ink discharge opening surface 81, the wiping sections 1*a*, 1*b*, 2*a* and 2*b* contact with the ink discharge opening surface 81 and then the wiping is performed. When the end portions of the wipers evacuate from an area of the moving path of the ink discharge opening surface 81, the wiping is not performed.

In a wiping process of the recording head H, it is operated that the ink discharge opening surface 81 is wiped off in the direction of moving from a portion of the second ink discharge opening array 35 to a portion of the first ink discharge opening array 32, and when the recording head H and the wipers 1 and 2 are relatively moved in the opposite direction, the wipers evacuate from the ink discharge opening surface 81. When the wiping operation is performed, the first wiper 1 and the second wiper 2 are disposed so that the first wiper 1 earlier rubs (passes) the ink discharge opening surface 81 prior to the second wiper 2. By performing the wiping operation in the above direction, it can be avoided that the first wiper 1 which just has wiped off the first ink discharge opening array 32 for discharging the black ink, wipes off the second ink discharge opening array 35 for discharging the color ink. Therefore, it is possible to avoid or reduce the problem of the color mixture or the like of the ink between the ink discharge opening arrays from occurring.

In FIG. 3, the first wiper 1 corresponding to the first ink discharge opening array 32 is disposed so that both the edges of the main wiping section 1*a* are positioned outside both the edges of the first ink discharge opening array 32 and pass inside both convex portions 33 and 33, and the notch portions 1*b* and 1*b* avoid both convex portions 33 and 33. The sub wiping sections 1*c* and 1*c* outside the first wiper 1 are disposed to pass the outside area of the convex portions 33 and 33 on the ink discharge opening surface 81. The second wiper 2 corresponding to the second ink discharge opening array 35 is disposed so that both edges of the main wiping section 2*a* are positioned outside both edges of the second ink discharge opening array 35 and pass inside both convex portions 36 and 36, and the notch portions 2*b* and 2*b* avoid both convex portions 36 and 36. The sub wiping sections 2*c* and 2*c* outside the second wiper 2 are disposed to pass the outside area of the convex portions 36 and 36 on the ink discharge opening surface 81.

When the wiping operation is started, the first wiper 1 initially contacts with the ink discharge opening surface 81 to start rubbing, and then the second wiper 2 contacts with the ink discharge opening surface 81 to start rubbing. The first wiper 1 moves while wiping off the ink discharge opening surface 81 by the main wiping section 1*a* and the sub wiping sections 1*c* and 1*c*; however, the main wiping section 1*a* runs on the convex portions 36 and 36 of both the edges of the second ink discharge opening array 35. Therefore, a sufficient wiping effect for the second ink discharge opening array 35 cannot be expected by the first wiper 1. While, within areas where the notch portions 1*b* and 1*b* of the first wiper pass, the wiping for the ink discharge opening surface 81 is not performed, a sufficient wiping effect can be obtained in the first ink discharge opening array 32, without being influenced by both convex portions 33 and 33.

Subsequently, the second wiper 2 moves while wiping off the ink discharge opening surface 81 by the main wiping section 2*a* and the sub wiping sections 2*c* and 2*c*. But, the main wiping section 2*a* does not run on the convex portions 33, 33, 36 and 36. That is, the second wiper 2 can surely wipe the second ink discharge opening array 35 without being influenced by any of the convex portions 33, 33, 36 and 36. Since the notch portions 2*b* and 2*b* of the second wiper pass through parts of the ink discharge opening array 32, the wiping is not performed within that corresponding areas. However, since the first ink discharge opening array 32 is sufficiently wiped off by the first wiper 1, the notch portions 2*b* and 2*b* do not give any influence to the wiping performance.

According to the present embodiment explained as above, in the wiping means for wiping off the ink discharge opening surface 81 on which the plural ink discharge opening arrays 32 and 35 respectively having the different lengths are disposed in parallel, the plural wipers 1 and 2 for wiping off the ink discharge opening surface 81 from the direction intersecting the ink discharge opening arrays 32 and 35 are provided. Further, the wipers 1 and 2 are provided with the main wiping sections 1*a* and 2*a* which correspond to the length of the corresponding ink discharge opening arrays 32 and 35; the notch portions 1*b*, 1*b*, 2*b* and 2*b* which are capable of avoiding the convex portions 33, 33, 36 and 36 located in the vicinity of both the edges of the corresponding ink discharge opening arrays; and the sub wiping sections 1*c*, 1*c*, 2*c* and 2*c* which correspond to the areas other than the ink discharge opening arrays. With the configuration, there is provided an inkjet recording apparatus having the wiping means capable of effectively wiping off the entire ink discharge opening surface 81 by performing the wiping under the mutual supplement by the wiping sections of the wipers, although there remain the portions which cannot be wiped off by the each independent wiper.

In the present embodiment, the case where the recording head H in which the two kinds of ink discharge opening arrays 32 and 35 respectively having different lengths are provided within the ink discharge opening surface 81, the long ink discharge opening array 32 is structured by the one ink discharge opening array, and the short ink discharge opening array 35 is structured by the plural (three) ink discharge opening arrays is wiped off, is explained by way of example. However, the present invention is not limited to the number of ink discharge opening arrays and the kind or length of the ink discharge opening array as described above. That is, if an inkjet recording apparatus is such apparatus that is equipped with the plural ink discharge opening arrays having the different lengths disposed in parallel on the ink discharge opening surface of the recording head, and the plural wipers for wiping off the ink discharge opening surface from the direction intersecting the ink discharge opening arrays, the present invention is widely applicable to such an inkjet recording apparatus. In the present embodiment, the case of forming the convex portions 33 and 36 on the portion located in the vicinity of both the edges of the ink discharge opening arrays 32 and 35 is explained by way of example. However, a case of forming the concave portions instead of the convex portions can be considered. The present invention is similarly applicable to a case of wiping off the ink discharge opening surface on which those concave portions are formed, and such a case is also included in the scope of the present invention.

Second Embodiment

Figure 4:
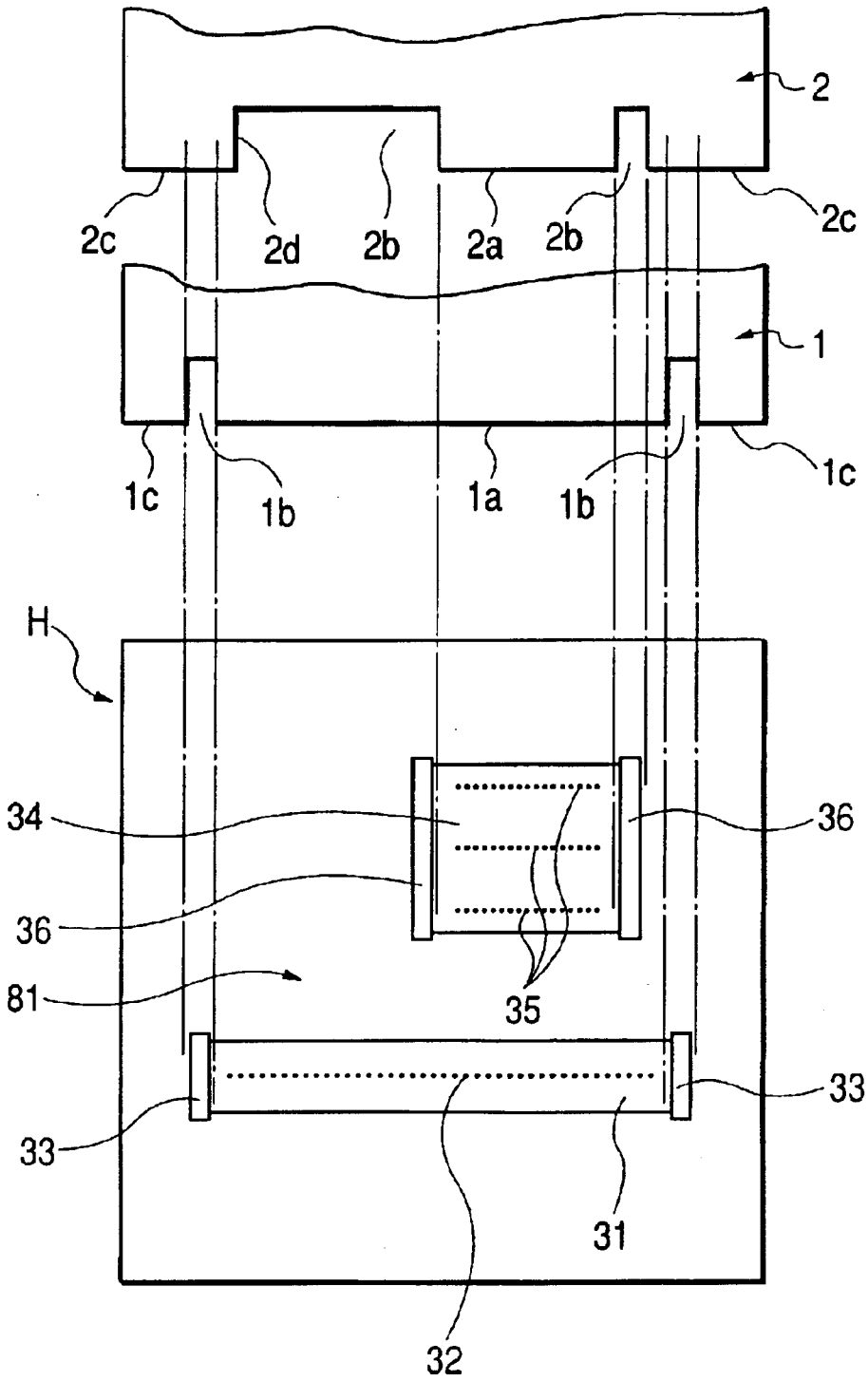
FIG. 4 is an explanation view schematically showing the disposition structure on a relative moving path between plural ink discharge opening arrays on an ink discharge opening surface of the recording head and end portion shapes of plural wipers of a wiping means in the second embodiment of an inkjet recording apparatus, to which the present invention is applied.

FIG. 4 is an explanation view schematically showing, on the basis of FIG. 3, the disposition structure on a relative moving path between plural ink discharge opening arrays on the ink discharge opening surface 81 of the recording head H and the end portion shapes of plural wipers of the wiping means 50 according to the second embodiment of the inkjet recording apparatus. In FIG. 4, according to the present embodiment, an edge portion (the left side edge portion shown in FIG. 4) 2*d* of the one of the notch portions 2*b* and 2*b* (the left side notch portion shown in FIG. 4) provided at the second wiper 2 corresponding to the second ink discharge opening array 35 is disposed outside the first ink discharge opening array 32 (outside the left edge portion shown in FIG. 4). In regard to the above point, the present embodiment is different from the first embodiment shown in FIGS. 2A and 2B and FIG. 3. However, the present invention has substantially the same structure as that in the first embodiment in regard to the points other than the above point, whereby the portions corresponding to those of the first embodiment shown in FIGS. 2A and 2B and FIG. 3 are denoted by the same reference numerals (or symbols), and the detailed explanation thereof will be omitted.

The present embodiment shown in FIG. 4 copes with a technical problem of suggesting that the ink droplets or the foreign substances wiped off by the wiping section tend to remain on a portion located in the vicinity of the edge portion of the wiping section. That is, this embodiment is structured so as to avoid as much as possible such disadvantage that the edge portion 2*d* of the sub wiping section 2*c* (in the present embodiment, the left sub wiping section shown in FIG. 4) (this edge portion is same as the left notch portion 2*b* of the left edge portion 2*d* shown in FIG. 4) passes inside the first ink discharge opening array 32 when the second wiper 2 passes the first ink discharge opening array 32. An effect of wiping off the entire ink discharge opening surface 81 by means of two sections of the wipers 1 and 2 can be sufficiently maintained according to the present embodiment shown in FIG. 4. Therefore, according to the present embodiment shown in FIG. 4, it is possible to maintain the ink discharge opening arrays 32 and 35 more effectively with a fine state as compared with the above embodiment shown in FIGS. 2A and 2B and FIG. 3.

The present invention is not limited to the number of recording heads or the number of ink discharge opening arrays explained in the above embodiments. Moreover, the present invention is not limited to the kinds or the number of colors to be used by a color inkjet recording apparatus for performing the recording by using the plural different colors, an inkjet recording apparatus used for the gradation recording for performing the recording with the plural different densities and the same color, an inkjet recording apparatus consisting of combination of the above recording apparatuses, and the like. That is, all the above structures as above-mentioned are included in the scope of the present invention.

The present invention is similarly applicable to any disposition or structure between the recording head and an ink tank, such as the structure of using a changeable inkjet cartridge integrally composed of the recording head and the ink tank, the structure of using the recording means of detachably mounting the ink tank on the recording head, and the structure of separating the ink tank from the recording head and connecting the ink tank with the recording head by an ink supplying path or the like. That is, according to the present invention, the same effect as above can be obtained even in any of such structures. Moreover, the present invention is similarly applicable to an inkjet recording apparatus which uses a recording head for applying energy by another operating method, e.g., an electromechanical converter such as a piezoelectric element. Even in this case, the same effect as above can be obtained. Among them, an excellent effect can be obtained in the inkjet recording apparatus using the recording head for discharging the ink by using thermal energy, because high-density recording and high-precision recording can be achieved according to such a method.

As apparent from the above explanation, according to the present embodiment, in the inkjet recording apparatus which performs the recording by discharging the ink to the recording material from the recording head having the ink discharge opening surface on which the plural different-length ink discharge opening arrays are disposed in parallel, the plural wipers for wiping off the ink discharge opening surface of the recording head from the direction intersecting the ink discharge opening arrays are provided. Moreover, the main wiping section corresponding to the length of the corresponding ink discharge opening array, the notch portions capable of avoiding the concave portions or the convex portions located in the vicinity of both the edges of the corresponding ink discharge opening array, and the sub wiping sections corresponding to areas other than the ink discharge opening array and the concave portions or the convex portions are provided at each wiper. Therefore, even if the ink discharge opening surface of the recording head having the plural different-length ink discharge opening arrays is wiped off by the plural wipers, the effective wiping can be performed with a simple structure. As a result, the inkjet recording apparatus which can easily output an excellent record result with an inexpensive mechanism can be provided.

What is claimed is:

1. An inkjet recording apparatus which performs recording by discharging inks to a recording material from a recording head having a discharge opening surface on which plural different-length discharge opening arrays are disposed in parallel, comprising:

plural wipers for wiping off the discharge opening surface in a direction intersecting said discharge opening arrays, wherein each of said plural wipers has a main wiping section corresponding to the length of the corresponding discharge opening array, notch sections capable of avoiding convex portions or concave portions located in a vicinity of both ends of the corresponding discharge opening array, and a sub wiping section corresponding to an area other than said discharge opening array and said convex or concave portions.

2. An inkjet recording apparatus according to claim 1, wherein said discharge opening surface on which said plural discharge opening arrays are disposed in parallel is formed by a single surface.

3. An inkjet recording apparatus according to claim 1, wherein an area which is not wiped off due to said notch section of each of said wipers is disposed to be wiped off by another wiper.

4. An inkjet recording apparatus according to claim 1, wherein an inner edge of said sub wiping section of each of said wipers is disposed not to pass inside of the corresponding discharge opening array of another wiper.

5. An inkjet recording apparatus according to claim 1, wherein said recording head is equipped with electrothermal converters for generating thermal energy to be used to discharge the ink.

6. An inkjet recording apparatus according to claim 5, wherein said recording head causes the ink to discharge from the discharge opening by using film boiling that occurs in the ink due to the thermal energy generated by said electrothermal converters.

7. A cleaning unit of an inkjet recording apparatus which performs recording by discharging inks to a recording material from a recording head having a discharge opening surface on which plural different-length discharge opening arrays are disposed in parallel, comprising:

plural wipers for wiping off the discharge opening surface in a direction intersecting said discharge opening arrays, wherein each of said plural wipers has a main wiping section corresponding to the length of the corresponding discharge opening array, notch sections capable of avoiding convex portions or concave portions located in a vicinity of both ends of the corresponding discharge opening array, and a sub wiping section corresponding to an area other than said discharge opening array and said convex or concave portions.

* * * * *